US005822970A

United States Patent [19]

Güttler

[11] Patent Number: 5,822,970

[45] Date of Patent: Oct. 20, 1998

[54] TRANSPORT APPARATUS FOR BOBBINS AND BOBBIN SLEEVES IN A TEXTILE PLANT

[75] Inventor: Herman Güttler, Uhingen, Germany

[73] Assignee: Zinser Textilmaschinen GmbH, Ebersbach/Fils, Germany

[21] Appl. No.: 823,059

[22] Filed: Mar. 21, 1997

[30] Foreign Application Priority Data

Mar. 22, 1996 [DE] Germany ..... 196 11 398.9

[51] Int. Cl.[6] ..... D01H 9/10

[52] U.S. Cl. ..... 57/281; 57/90; 57/270

[58] Field of Search ..... 57/90, 270, 281; 242/35.5 A

[56] References Cited

U.S. PATENT DOCUMENTS

| | | | |
|---|---|---|---|
| 3,828,682 | 8/1974 | Klein | 57/281 |
| 4,720,967 | 1/1988 | Guttler | 57/281 |
| 4,999,988 | 3/1991 | Roder et al. | 57/281 |
| 5,010,725 | 4/1991 | Yasui et al. | 57/281 |
| 5,365,728 | 11/1994 | Mack | 242/35.5 A |
| 5,555,713 | 9/1996 | Wussmann et al. | 57/281 |

FOREIGN PATENT DOCUMENTS

| | | | |
|---|---|---|---|
| 0 314 631 | 3/1989 | European Pat. Off. . | |
| 6-24653 | 2/1994 | Japan | 57/281 |
| 93/01336 | 1/1993 | WIPO | 57/281 |

*Primary Examiner*—William Stryjewski
*Attorney, Agent, or Firm*—Herbert Dubno

[57] ABSTRACT

A roving frame and spinning machine system in which each roving frame is coupled with a plurality of spinning machines via a respective suspension track system having a respective transporter for transferring bobbins from the roving frame to the spinning machine and empty sleeves from the spinning machines to the roving frame. Branch and switch tracks are provided between the track systems and the transporters for gaps between their leading and trailing ends and couplings enabling a segment of one transporter to be decoupled therefrom and coupled to the end of another transporter when, in conjunction with the operation of the switch tracks, one of the ring spinning machines is transferred from one group to the other group.

5 Claims, 5 Drawing Sheets

TRANSPORT APPARATUS FOR BOBBINS AND BOBBIN SLEEVES IN A TEXTILE PLANT

FIELD OF THE INVENTION

The present invention relates to a transport apparatus for transporting bobbins and bobbin sleeves in a textile plant and to a method of operating such a transport apparatus. More particularly, the invention relates to a process of forming roving on an initial processing machine such as a roving frames from sliver and winding the roving on a roving bobbins, wherein the roving bobbins are transported by a suspension track system to subsequent processing machines such as spinning frames, and wherein the bobbin cores or sleeves are returned to the roving frames by the suspension track system. The invention is is directed, more particularly, to a system of this type wherein a group of subsequent processing machines or spinning frames is assigned to the roving frame and the track system couples each roving frame with a multiplicity of spinning frames of the respective group. In general, the track system includes stretches of track extending along the sides of each of the subsequent processing machines or spinning frames in a respective track loop.

BACKGROUND OF THE INVENTION

It is known, for example from EP 0 314 631, to interconnect a group of ring spinning machines, for example, with roving frames, utilizing a track system and an endless transporter, for example in the form of an endless chain, which can transport the roving bobbins to the ring spinning machines and the empty bobbin sleeves or cores from the ring spinning machines back to the roving frames. The track system includes loops between the ring spinning machines so that at each of the spinning stations of the ring spinning machine, a respective bobbin can be positioned to enable service personnel to transfer the bobbin to the ring spinning machine and to return empty core sleeves to the transporter with a minimum of reach and effort.

As a rule, a roving frame can service a certain group of ring spinning machines by supplying them with the roving bobbins and thus a number of ring spinning machines can form a machine group which can be said to be assigned to a particular roving frame.

In practice, it has been found to be necessary to transfer a ring spinning machine from one group to the other or to alter the machines which are considered to be part of the group assigned to a particular roving frame. With an endless transporter arrangement, this is scarcely possible without major problems and time consuming efforts in dismounting parts of the transporter, reconnecting portions of a transporter from which parts have been removed, and, in general, major efforts in reworking the track and/or transporter arrangement.

OBJECTS OF THE INVENTION

It is the principal object of the present invention to provide a transport apparatus and method of operating same which can overcome these drawbacks.

More particularly, it is an object of the invention to provide an improved transport apparatus, which allows for variation in the transport path of a suspension track system connecting a plurality of subsequent processing machines such as spinning frames with an initial processing machine, for example, a roving frame, whereby drawbacks of earlier systems are avoided and changes in path for the transporter can be achieved with significantly less effort and with significantly reduced time.

SUMMARY OF THE INVENTION

These objects and others which will become apparent hereinafter are attained, in accordance with the invention, in a system wherein

- the suspension tracks of two groups of the subsequent operating machines, e.g. ring spinning machines, are interconnected by branch (switch) tracks which can be shifted to connect at least one of the subsequent operating machines of one group in another group;
- the transporter is provided so that it has an end portion at at least one end of a length subsequently equal to the track loop lengths of this machine and thus forms a transfer segment which can be decoupled from one transporter and connected to an end of the other transporter; and
- by providing a short gap between the ends of the transporters, i.e. by interrupting the transporters so that they are not endless.

Under these conditions, I can provide a transport apparatus for bobbins and bobbin sleeves which comprises:

- a respective suspension track extending in respective loops along opposite sides of the subsequent processing machines of a respective group of the subsequent processing machines assigned to each of the initial processing machines and to the respective one of the initial processing machines;
- branch tracks between the suspension tracks of the groups selectively operable to transfer a loop of one of the subsequent machines from the suspension track of one of the groups to the suspension track of another of the groups;
- a respective elongated transporter on each of the suspension tracks, slightly shorter than the length of the respective suspension track, and provided with means for suspending selectively respective bobbins and bobbin sleeves from the transporter; and
- means for decoupling a transfer segment of one of the transporters from an end of the one of the transporters and coupling the decoupled transfer segment onto an end of another of the transporters, the transfer segment having a length corresponding substantially to the length of the loop.

In method terms the number of subsequent operating machines or ring spinning machines assigned to a group services by a roving frame can be altered by disconnecting a segment of the suspension carriage train or transporter of one track and connecting this segment to the suspension carriage train or transporter of the other track while shifting the branch or switch tracks to include the transfer ring spinning machine in the new group.

The method can comprise the steps of:

a) displacing a respective elongated transporter on each of respective suspension tracks extending in respective it loops along opposite sides of the subsequent processing machines of a respective group of the subsequent processing machines and to the respective one of the initial processing machines, each of the transporters selectively receiving bobbins and bobbin sleeves for the transport of the bobbins from the initial processing machines to the subsequent processing machines of the respective group and for transporting bobbin sleeves from the subsequent processing machines to the initial processing machines assigned to the respective group; and b) for transferring a subsequent processing machine from one group to another of the groups, decoupling a transfer segment of the transporter of the one group from an end of the respective transporter and coupling the decoupled transfer segment onto an end of the transporter of the other of the groups.

As a consequence, the number of subsequent operating machines assigned to an initial operating machine can be increased or reduced utilizing the branch tracks when the gap in the respective suspension carriage train or transporter is located in the region of the branch track, thereby eliminating any need to first disassemble an endless transporter before branch tracks can be rendered effective.

Furthermore, the presence of a gap in the transporter allows the branch tracks to be reset and the path for a particular transporter altered even if a transfer segment of one transporter is not decoupled therefrom and reconnected at an end of another transporter.

The distance between the ends of a transporter and hence the length of the gap should be sufficient to span the branch or switch track region at which branch tracks may be switched. Since this distance can increase or decrease depending upon the path, the gap also serves to allow compensation for different path lengths of the transporter.

Since the transfer segment has a length which corresponds essentially to the length of the loop of the machine which is transferred from one group to the other, the decoupling of the segment from one transporter and its reconnection to the transporter of the other group generally will not alter the length of the gaps in the two transporters. I have found that the transporters functionally operate equivalent to an endless transporter and, with appropriate selection of the length of the gap, practically no station of the spinning frames will remain unserviced or will not be juxtaposed with a bobbin carrying region of the respective transporter.

While it is known in conjunction with suspension track systems to use suspension carriage trains from which bobbins and bobbin sleeves are suspended, these suspension carriage trains have generally been very short by comparison with the length between a group of spinning machines and the respective roving frame. As a consequence, timing of the correct movements of such trains has been a problem since the relatively short suspension carriage trains must be introduced with the proper timing and at the proper locations into the spinning machine array. The control systems required for this purpose were relatively complex. By contrast, the resetting of the branch tracks in the system of the invention is seldom required since such resetting is only necessary when it is desired to transfer a machine from one group to the other.

The transporter must be open, i.e. having a gap as has been described between leading and trailing ends so that, when the gap passes over the branch track regions, the branch or switch tracks can be operated. The transporter should, however, be as long as possible and the gap, therefore, as short as possible so that any stretch of the gap juxtaposed with the ring spinning machine, should not encompass spinning stations or should only encompass the minimum number required and therefore so that there is no interference with the replacement of bobbins and sleeves. The gap must, however, be long enough to permit reliable operation of the switch tracks between the leading and trailing ends of the transporter. If the switch tracks are switched on the fly, the length of the gap will depend upon the speed of the transporter, with the speed with which the position of the gap in the region of the branch tracks can be detected and the commands transmitted to the switch tracks and the speed with which the switches can operate. On the other hand, the length of the gap is not critical and can vary depending upon slight differences in the lengths of different path patterns.

The transporter must, as a consequence of the presence of the gap, be driven at at least two locations along its length and these locations should have a spacing along the path which is greater than the maximum length of a gap and advantageously is about half the length of the transporter.

Because of the presence of the gap, the transporter is displaced at least in part by thrust and thus while the transporter is advantageously flexible in a horizontal plane so as to enable it to travel along the bends of the loops, it should be stiff in the thrust direction, i.e. along the length of the transporter and may be made up of chain links which can drive the chain in tension and in thrust.

With the system of the invention, the suspension track need only be of a length necessary to provide the loops along the spinning machines and the connection to the roving frame. Extra storage tracks can be avoided as can lengths of track which must accommodate the transporter for changes in the track organization. For the switching of one or another roving frame to another group, it is merely necessary to shift the transfer segment from one transporter to the other and the lengths of the transporter can then vary only depending upon how the transfer segments are coupled.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
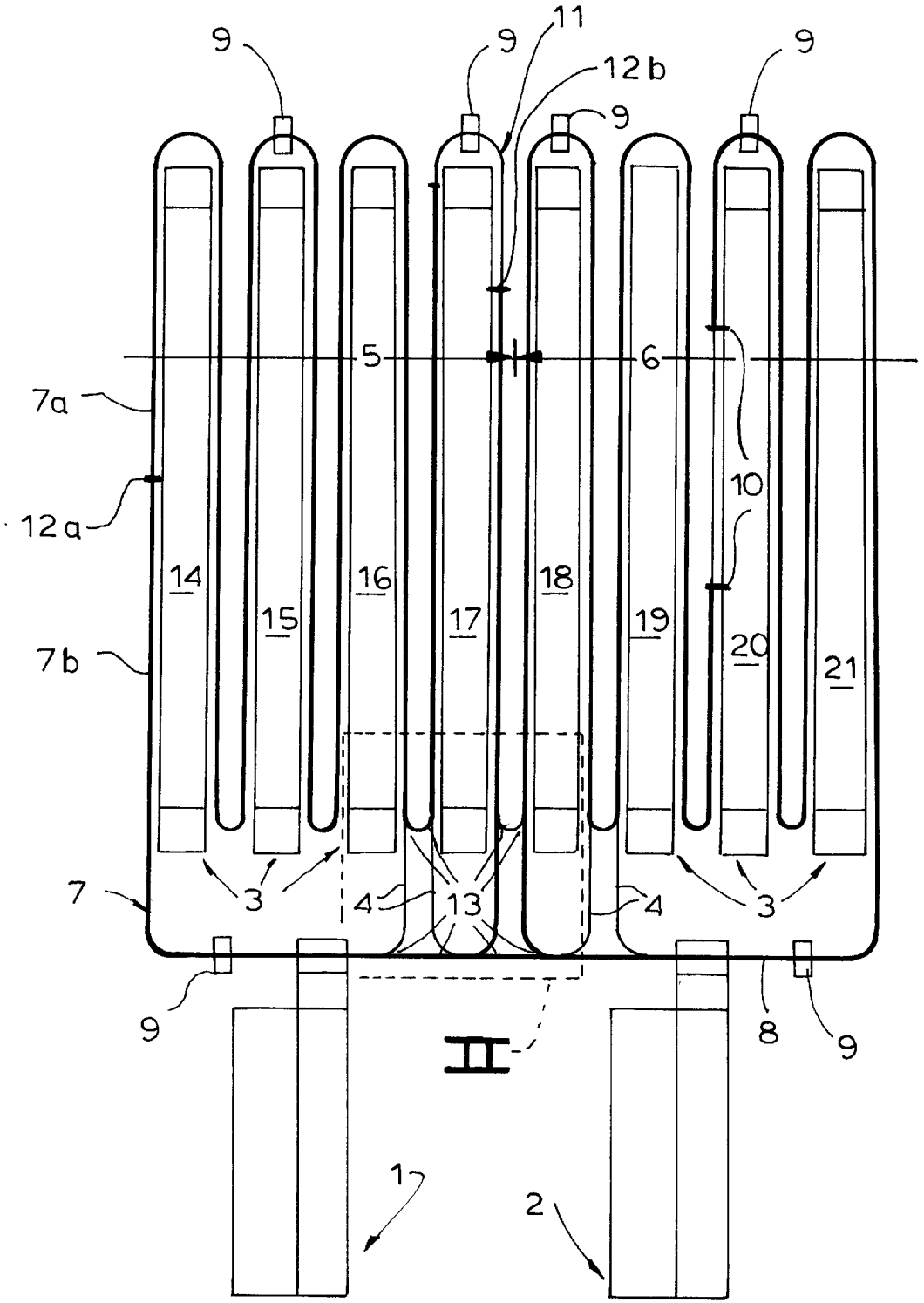
FIG. 1 is a diagrammatic plan view of a textile plant having two roving frames and two groups of spinning frames according to the invention.
Figure 4:
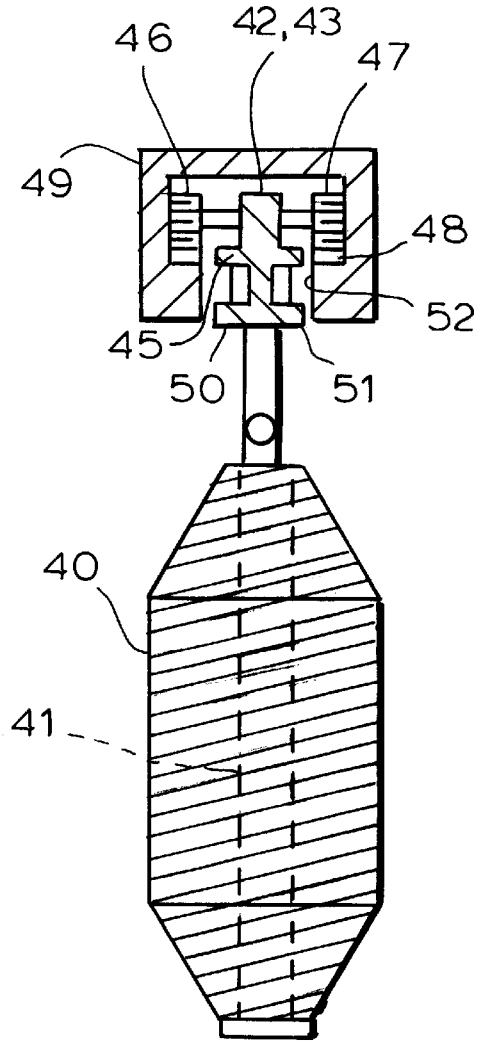
FIG. 4 is a vertical cross sectional view through a section of the suspension track showing how the links are suspended.

The plan view of FIG. 1 shows two machine groups each consisting of one roving frame 1 or 2 constituting the initial processing machine, and four ring spinning machines 3, constituting the subsequent processing machines. By means of a suspension track system and a transporter travelling therealong, the roving bobbins 40 (FIG. 4) formed in the roving frame can be delivered from the roving frame to the respective spinning stations of a spinning frame of the respective group and the resulting core sleeve 41 (FIG. 5) returned from the ring spinning machine to the roving frame. The transfer of full bobbins from the roving frame to the transporter and from the transporter to the creels of the ring spinning machines and of empty sleeves from the transporter to the roving frame can be effected by hand by service personnel or by automatic doffing apparatus. A combination of manual and automatic doffing is also possible.

Each group of the ring spinning machines 3 is connected with the respective roving frame 1 by a closed track portion 5 or 6 along which a transporter 7 or 8 in the form of a suspension train is displaceable.

The transporter 7, 8 is, as is known in this field, a suspension train on which the full bobbins or empty sleeves can be suspended (FIGS. 4 through 6) and which can be driven by two drive units per track region 5, 6, for example, motor-driven roll pairs. The transporter 7, 8 is also somewhat shorter than the length of the track region 5, 6 on which it is provided so that between leading and trailing ends of the transporter, a gap 10 or 11 is provided. For this reason, each transporter cooperates with at least two drive units 9.

The transporters 7, 8 are provided at least at one end and generally at both ends with segments such as that shown at 7*b* in FIG. 1 which are connected to the balance of the transporter 7*a*, for example, with releasable couplings 12, 12*a*, 12*b* represented diagrammatically in FIGS. 1, 2*a* through 2*f* as double transverse lines.

Figure 6:
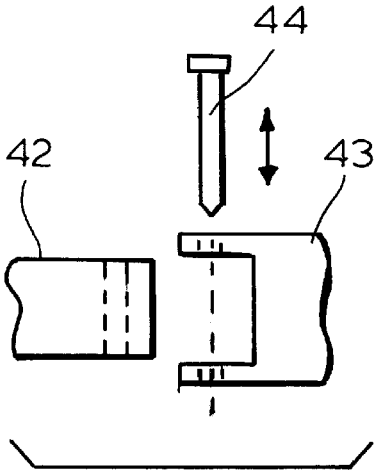
FIG. 6 is an exploded view showing the decoupling of a segment of the transporter from the remainder thereof.
Figure 5:
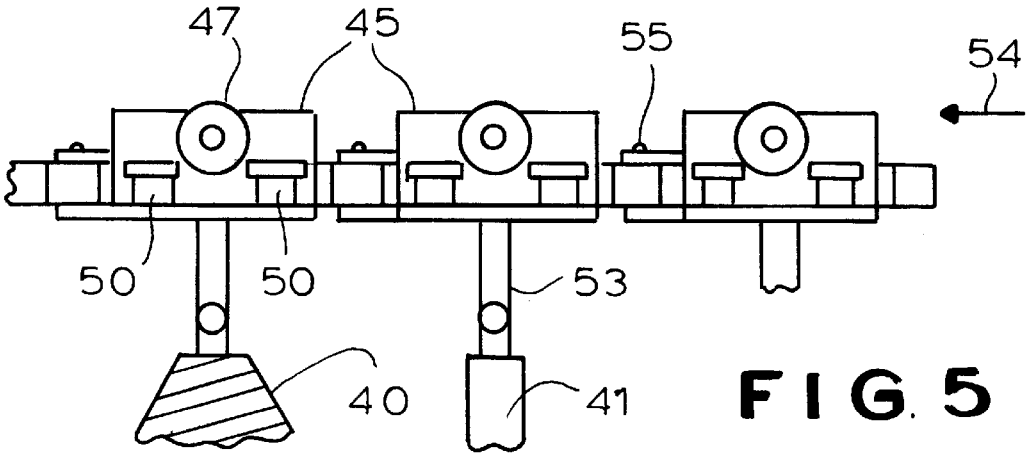
FIG. 5 is a side view in diagrammatic form of a portion of a transporter.

In FIG. 6, such a coupling can be a connection between two links 42 and 43 of a chain which can be connected by a removable pin 44. When the pin is withdrawn, the coupling is decoupled and the segment 7*a* can be separated from the balance of the transporter 7. As can be seen from FIG. 4, each of the links 42, 43 can comprise a link body 45 having a pair of wheels 46, 47 rolling on ledges 48 of the inverted channel-shaped track 49 and carrying lateral wheels 50 and 51 which are guided on flanks 52 of the channel. The wheels 47 and 50 are also visible in FIG. 5 which also shows the hangers 53 for the bobbins 40 and the sleeves 41. The trains are rigid in the thrust direction 54 as shown in FIG. 5 and the links are coupled by pins 55.

The suspension track regions 5, 6 of the two machine groups formed by the initial processing machines 1, 2 and the subsequent processing machines 3 are interconnected by branch or switch tracks 13 and branches 4. The switch tracks 13 are so provided that the track portions 5 and 6 can be separated from one another and, by adjustment of the switch tracks, at least one of the ring spinning machines 17 or 18 or both can be connected to the other group. In FIG. 1, the ring spinning machines 14 to 17 form the group assigned to roving frame 1 while ring spinning machines 18 to 21 form the group assigned to roving frame 2. The respective transporters 7 and 8 have been shown with thick lines.

When the ring spinning machine 17 is to be transferred from the group assigned to roving frame 1 to the group assigned to roving frame 2, the gap 11 in the transporter 7 is positioned in the region of the ring spinning machines 16, 17, 18, the transporters for the two machine groups having been differently hatched so as to show their different paths.

When one of the gaps 10 or 11 are in place (FIG. 2*b*) the switch tracks of the track group 22 are available for operation and the transporters via their drive unit 9 are brought to standstill. The branch tracks 22 are swung in the directions represented by the small arrows in FIG. 2*b* and the segment 7*b* is released from transporter 7 at the respective coupling 12.

Figure 2A:
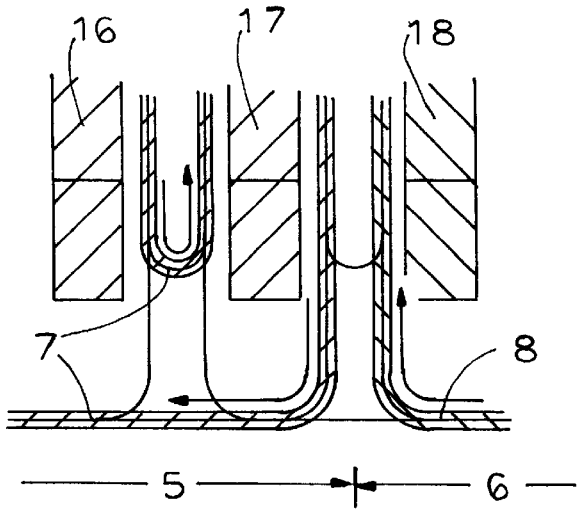
FIGS. 2*a* through 2*f* are diagrammatic views in the region II of FIG. 1 showing successive steps in the transfer of one machine between groups.
Figure 2C:
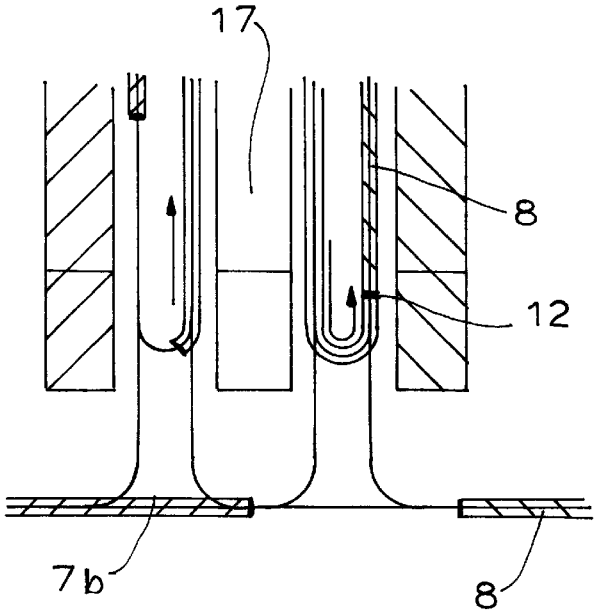
Figure 3:
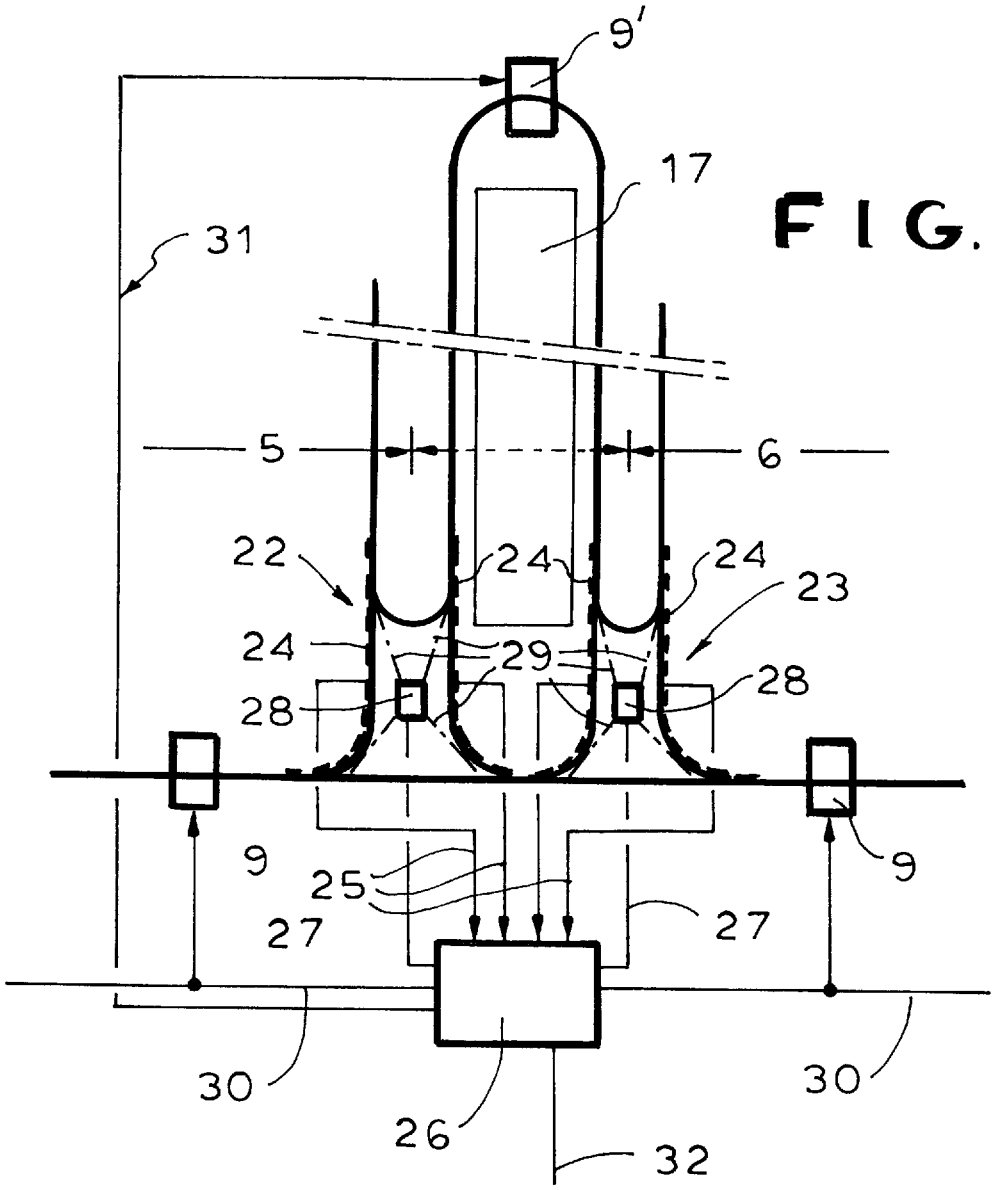
FIG. 3 is a detail of a portion of FIG. 1.

As shown in FIG. 2*c*, the decoupled track segment is displaced under the control of the controller unit (9' in FIG. 3, which here acts as the driver), the end of the transporter segment 7*b* being then coupled to the end of the transporter 8.

Figure 2E:
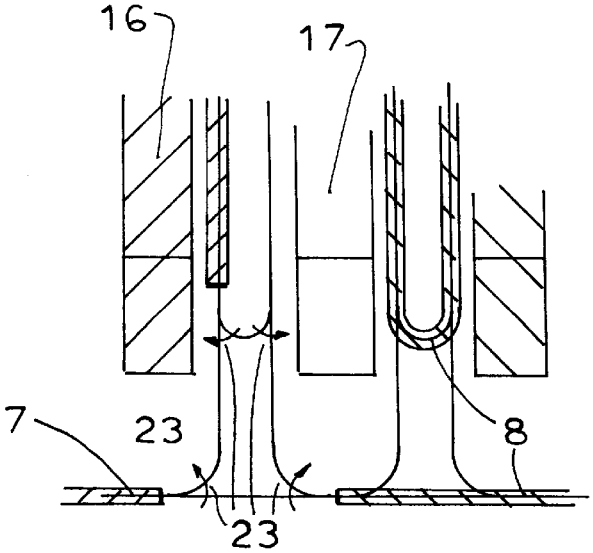
Figure 2B:
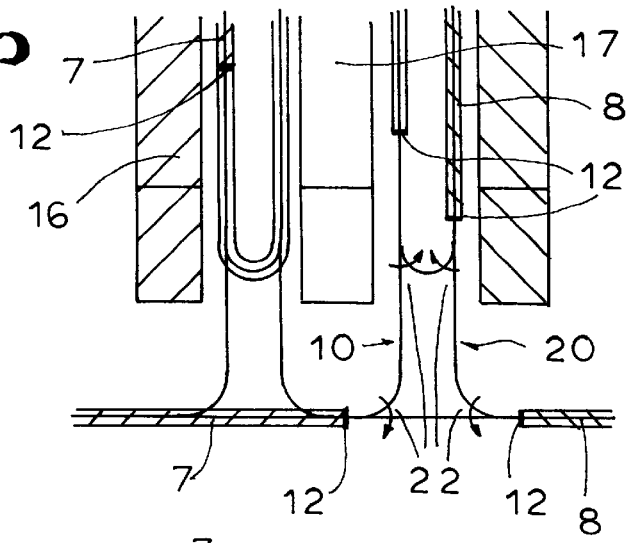
Figure 2D:
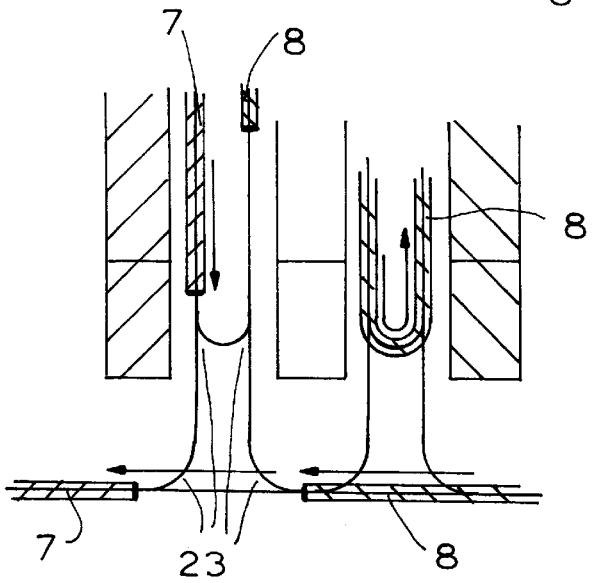
Figure 2F:
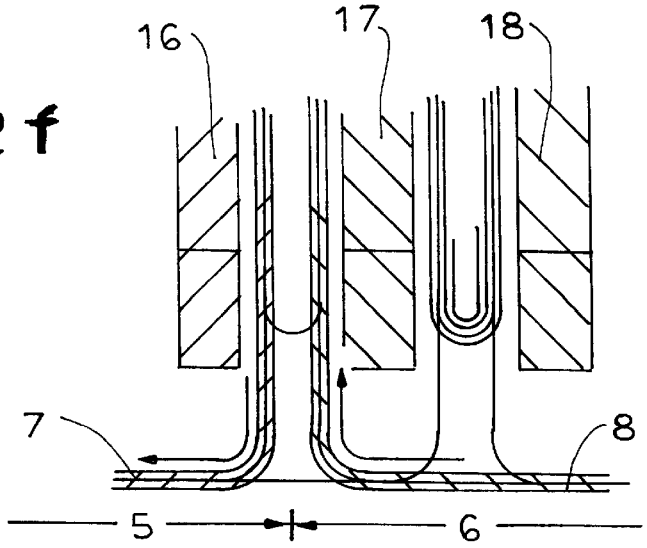

The two transporters are then displaced (FIG. 2*d*) as represented by the arrows via their respective drivers 9 to free the switch track group 23. These switch tracks are then operated as shown in FIG. 2*e* so that the transporter 8 will now service the ring spinning machine 17 which has been added to the group assigned to the transporter 8 (FIG. 2*f*). As can be understood from the foregoing, the end segment of one transporter is transferred to the track of the other group. In a similar manner, not described here, a leading portion of one of the transporters can be transferred to the other suspension track region.

In the region of the track at which a ring spinning machine is to transfer from one group to another, a respective drive unit 9 must be provided so that the segment which is decoupled from one transporter can be moved into engagement with the other. If desired, however, such movement can be effected by hand. Since this driver effectively is transferred with its ring spinning machine to another group, there must be two drivers remaining for the transporter of the original group. While the transfer can be effected manually and can be monitored by personnel, it has been found to be advantageous to provide means for automatically effecting the transfer. For this purpose, in the region of the two switch track groups 22 and 23 sensors 24 are provided which detect the gaps 10 and 11 in the transporters 7, 8. The sensors 24 can be contact or switch members, light curtains or the like. They can be connected via conductors 25 with a control unit 26 which can be connected in turn via lines 27 with effectors 28 for operating the switches of the groups 22 and 23. The lines 29 represent coupling of the controllers to the switches. The control unit 26 can include a microcomputer which is programmed for the sequence of steps described above. The control unit 26 can be connected via lines 30 with the various drive units 9. In the region of the ring spinning machine 17 which can be transferred, a separate drive unit 9' can be provided which is connected via the line 31 with the control unit 26. When the control unit via line 32 receives a command to effect the aforedescribed transfer, it activates the sensors 24 in the region of the switch track group 23. As soon as one of these sensors 24 senses a gap 10 or 11 in one of the transporters 7 or 8, a signal is supplied to line 27 and the control unit 26 shuts down the drives 9, 9' via line 30.

When the gaps 10 and 11 of the two transporters thus leave the group 23 of switch tracks free to operate, the controller 26 via lines 27 and the corresponding actuators or effectors 28, operates the branch tracks.

The coupling 12 can be released by hand although it can be automatically releasable and re-engageable if a remotely actuated coupling is provided as desired.

The control unit 26 then energizes the drive 9' to displace the decoupled segment to engage the other transporter. The control unit 26 then energizes the drives 9, 9' so that the other switch track group 22 is free and, as monitored by the sensors 24, can operate to allow the new lengthened transporter to travel along the switched machine. The drives 9, 9' can then be operated by the controller for normal travel of the transporters 7 and 8 with the regrouped machines.

The arrangement of the branch tracks 24 shown in FIG. 1 allows regrouping of either of the ring spinning machines 17, 18 to the other group and if additional ring spinning machines are to be regrouped, they must be provided with additional branch and switch tracks.

While FIG. 1 shows an embodiment with only two groups of ring spinning or subsequent processing machines, it is also possible to provide additional groups of ring spinning and roving machines and to connect these additional groups shown by appropriate branches and switch tracks. It is also possible to provide machine groups with a greater or lesser or number of spinning machines than the preferred four which have been shown.

It is advantageous to provide the transporters 7, 8 at distances along their length which correspond to the loop length for a ring spinning machine, with couplings 10 to allow greater versatility in the transfer of leading and trailing segments.

I claim:

1. A transport apparatus for bobbins and bobbin sleeves in a textile plant for processing roving and wherein each of at least two initial processing machines is coupled with a respective group of multiplicity of elongated subsequent processing machines and the transport apparatus displaces bobbins from the initial processing machines to the subsequent processing machines and bobbin sleeves from the subsequent processing machines to the initial processing machines, said transport apparatus comprising:

at least two suspension tracks each extending in a respective loop along opposite sides of the respective group of said subsequent processing machines;

branch tracks between the suspension tracks of said groups selectively operable to transfer a loop of one of said subsequent machines from the suspension track of one of said groups to the suspension track of another of said groups;

a respective elongated transporter on each of said suspension tracks, slightly shorter than the length of the respective suspension track, and provided with means for suspending respective bobbins and bobbin sleeves from the transporter; and means for decoupling a transfer segment of one of said transporters from an end of said one of said transporters and coupling the decoupled transfer segment onto an end of another of said transporters, said transfer segment having a length corresponding substantially to the length of the respective loop.

2. The transport apparatus defined in claim 1 wherein said transporter is rigid in a longitudinal direction thereof while transporting said bobbins and bobbin sleeves between the initial processing machines and the subsequent processing machines.

3. The transport apparatus defined in claim 1 wherein said transporter comprises a chain of links.

4. The transport apparatus defined in claim 1, further comprising sensors responsive to the presence of a gap in one of said transporters in a region of said branch tracks, a controller responsive to said sensors, and means for operating said branch tracks and terminating movement of said transporter in response to said controller when said gap is located at said branch tracks.

5. A method of operating a transport apparatus for bobbins and bobbin sleeves in a textile plant for processing roving and wherein each of at least two initial processing machines is coupled with a respective group of multiplicity elongated processing machines and a transport apparatus displaces bobbins from the initial processing machines to the subsequent processing machines and bobbin sleeves from the subsequent processing machines to the initial processing machines, said method comprising the steps of:

a) displacing a respective elongated transporter on each of respective suspension tracks extending in respective loops along opposite sides of a respective group of the subsequent processing machines and to the respective one of the initial processing machines, each of said transporters selectively receiving bobbins and bobbin sleeves for the transport of the bobbins from said initial processing machines to the subsequent processing machines of the respective group and for transporting bobbin sleeves from the subsequent processing machines to the initial processing machines; and b) for transferring a subsequent processing machine from one group to another of said groups, decoupling a transfer segment of the transporter of said one group from an end of the respective transporter and coupling the decoupled transfer segment onto an end of the transporter of the other of said groups.

* * * * *